US005328314A

United States Patent [19]

Marchadour

[11] Patent Number: 5,328,314

[45] Date of Patent: Jul. 12, 1994

[54] DEVICE FOR CLOSING FOOD CANS AT A HIGH RATE

[75] Inventor: Jean-Charles Marchadour, Saint Jean Trolimon, France

[73] Assignee: Hema Technologies, Quimper, France

[21] Appl. No.: 38,527

[22] Filed: Mar. 29, 1993

[30] Foreign Application Priority Data

Mar. 31, 1992 [FR] France ..... 92 03907

[51] Int. Cl.[5] ..... B21D 51/32

[52] U.S. Cl. ..... 413/37; 53/334; 53/336; 53/366

[58] Field of Search ..... 413/6, 31, 36, 37; 53/334, 335, 336, 337, 338, 339, 340, 366

[56] References Cited

U.S. PATENT DOCUMENTS 1,202,476 10/1916 Brenzinger ..... 413/31
3,006,304 10/1961 Renzi ..... 413/37
3,868,917 3/1975 Arfert ..... 113/1
3,902,438 9/1975 Smith ..... 413/37

FOREIGN PATENT DOCUMENTS 2303713 8/1976 France ..... 7/28
2464190 6/1981 France ..... 7/28
1190381 5/1970 United Kingdom ..... 7/28

*Primary Examiner*—Jack Lavinder
*Attorney, Agent, or Firm*—Michael, Best & Friedrich

[57] ABSTRACT

The device includes a compression stand on which a food can is placed and which is driven with vertical translation motion by a telescopic rod under the control of a cam-follower roller engaged in a cam track. During the upstroke of the rod, its two component elements are hydraulically locked together by the presence of oil in an intermediate chamber that is closed. At the top end of the stroke, the oil can escape through a passage, thereby releasing a spring which determines the force with which the can is pressed against the stationary mandrel while the lid is actually being crimped thereon.

8 Claims, 2 Drawing Sheets

DEVICE FOR CLOSING FOOD CANS AT A HIGH RATE

FIELD OF THE INVENTION

The present invention relates to a device enabling the lid of a food can to be crimped in place, the device comprising a crimping head and a compression stand for supporting the body of a food can on which a lid has been placed, and for pressing said lid onto the body of the can by urging the can against a fixed mandrel with a determined force throughout the crimping operation. The compression stand is fixed to the end of a first element of a telescopic rod that extends along an axis perpendicular to the support surface provided by the compression stand and that comprises two elements capable of sliding one relative to the other, which elements are associated with a spring that urges them apart from each other, the second element being coupled to drive means suitable for imparting longitudinal reciprocating translation motion thereto between two defined extreme positions, namely a rest position at a distance from the above-specified mandrel and a working position causing the mandrel to hold the lid down on the body of the can against the thrust imparted via said spring, the first element of the rod, and the compression stand.

BACKGROUND OF THE INVENTION

The function of the compression stand is to enable the lid to be pressed against the body of the can with greater or lesser force during the closure stage proper during which the edge of the lid is rolled over the edge of the body of the can and is then flattened out in order to obtain a sealed connection by peripheral crimping. The pressure exerted on the lid has a determining influence on the quality of the crimping roll formed around the edge of the lid. For any given type of can, said pressure should remain at a well-determined constant value: pressure that is too low or too high leads to faulty crimping.

In the mechanism described above, the compression stand bears, via the spring, against the second above-mentioned element which serves as a control member, the assembly performing reciprocating motion that is performed at an increasing rate with an increasing crimping throughput.

When the rate is low, inertia phenomena are small and the compression stand tracks the displacements of the control member accurately, with the spring remaining is a substantially constant state.

As the rate increases, the inertia of the compression stand and of the first element to which it is fixed subjects the spring to force on each stroke of the assembly towards the can to be closed. Since the spring exerts the pressure required for crimping properly only when stabilized, it will be understood that the degree of compression departs from the desired value and that the faster the rate the greater the departure, particularly if the cans to be closed are of a type that requires only a small amount of compression force, and thus a spring that is relatively weak (as applies, for example, to thin-walled cans made of light alloy).

Incompatibility thus appears to exist between closing food cans at a high rate and obtaining low compression force thereon during the crimping operation.

OBJECT AND SUMMARY OF THE INVENTION

An object of the present invention is to overcome that incompatibility. To this end, according to the present invention, the telescopic rod is provided with means for mutual temporary locking together of the two component elements of the rod, which means keep said elements stationary relative to each other in a relative position where the spring is in a state of determined prestress, with this taking place during the major fraction of the stroke of the first element towards the mandrel, and then, shortly before the end of said stroke, releasing the second element from the first, so that the first element then causes the lid to be pressed against the body of the can solely under the effect of the force developed by the spring under said prestress, regardless of the small or large value thereof.

Because of the above dispositions, the stroke of the rod carrying the compression stand is subdivided into two portions: a first portion where the two locked-together elements of the rod behave like a single one-piece part, such that the compression stand accurately performs the motion imparted thereto by the drive means, regardless of the amplitude of the imparted acceleration, and without the spring being subject to any corresponding force. Thereafter, in a second portion, which corresponds to the end of the stroke of the compression stand, the first element becomes dissociated from the second element so as to be connected thereto solely by means of the spring. The spring then performs its function of exerting the desired compression force on the lid to be crimped.

It is thus now possible to perform crimping on food cans at a high throughput while nevertheless ensuring that the lids are subjected to a compression force that is accurate and constant, and that may optionally be small.

In a preferred embodiment, the locking means between the two elements of the telescopic rod comprise a chamber delimited by walls belonging to respective ones of said two elements, the inside volume of the chamber being directly determined by the mutual position of said elements as they slide relative to each other, the locking means also comprising abutment means which set the position of maximum extension of the rod. The chamber is permanently connected to a source of liquid under pressure, and also to a path for discharging said liquid from the chamber, but only when the rod reaches its end-of-stroke position close to the mandrel. The liquid filling the chamber froms an incompressible hydraulic cushion imprisoned between these two elements, causing them to be firmly secured relative to each other, with with the two elements being suddenly released from this connection as soon as the liquid can escape from the chamber. The chamber may be connected to the source of liquid under pressure via a duct that includes a non-return valve, which prevents any hydraulic liquid returning to the source during the compression stage and which provides perfect confinement of the hydraulic liquid in the chamber, even if the source delivers the liquid at a pressure that is not very high.

Preferably, the device is designed in such a way that the inside volume of the chamber increases or decreases as the elements of the rod slide relative to each other, thereby respectively extending the rod or retracting it. In which case, it is appropriate for the chamber to be delimited by an end wall and by a tubular side wall belonging to one of the two elements of the rod, and by a piston constituted by the end of the other element, said piston being slidably received in the chamber, and for said side wall to be pierced by a first orifice in permanent communication with the source of fluid under pressure, and by a second orifice that communicates with a discharge duct only at the end of the stroke of the element to which the said side wall belongs.

In a particular embodiment, the element to which the side wall of the chamber belongs is the first element, the piston being constituted by the end of the second element.

The above-mentioned the abutment means may comprise a pin passing through both of the first and the second elements of the rod, passing through at least one of said elements via a slot or a pair of slots enabling the two elements to slide relative to each other with an amplitude greater than the residual stroke executed by the second element after being unlocked from the first element, thereby avoiding any danger of the spring being mechanically short circuited by the pin at the end of the stroke. It is also appropriate for the ends of the pin to be received in a pair of guide grooves formed in a stationary part and extending in the same direction as the axis of the telescopic rod, thereby stabilizing the telescopic rod about its axis, preventing it from rotating, and thus constraining the compression stand to keep the same orientation relative to the fixed mandrel.

BRIEF DESCRIPTION OF THE DRAWINGS

Other features and advantages of the invention appear from the following description of a non-limiting embodiment given with reference to the accompanying drawings.

MORE DETAILED DESCRIPTION

Figure 1:
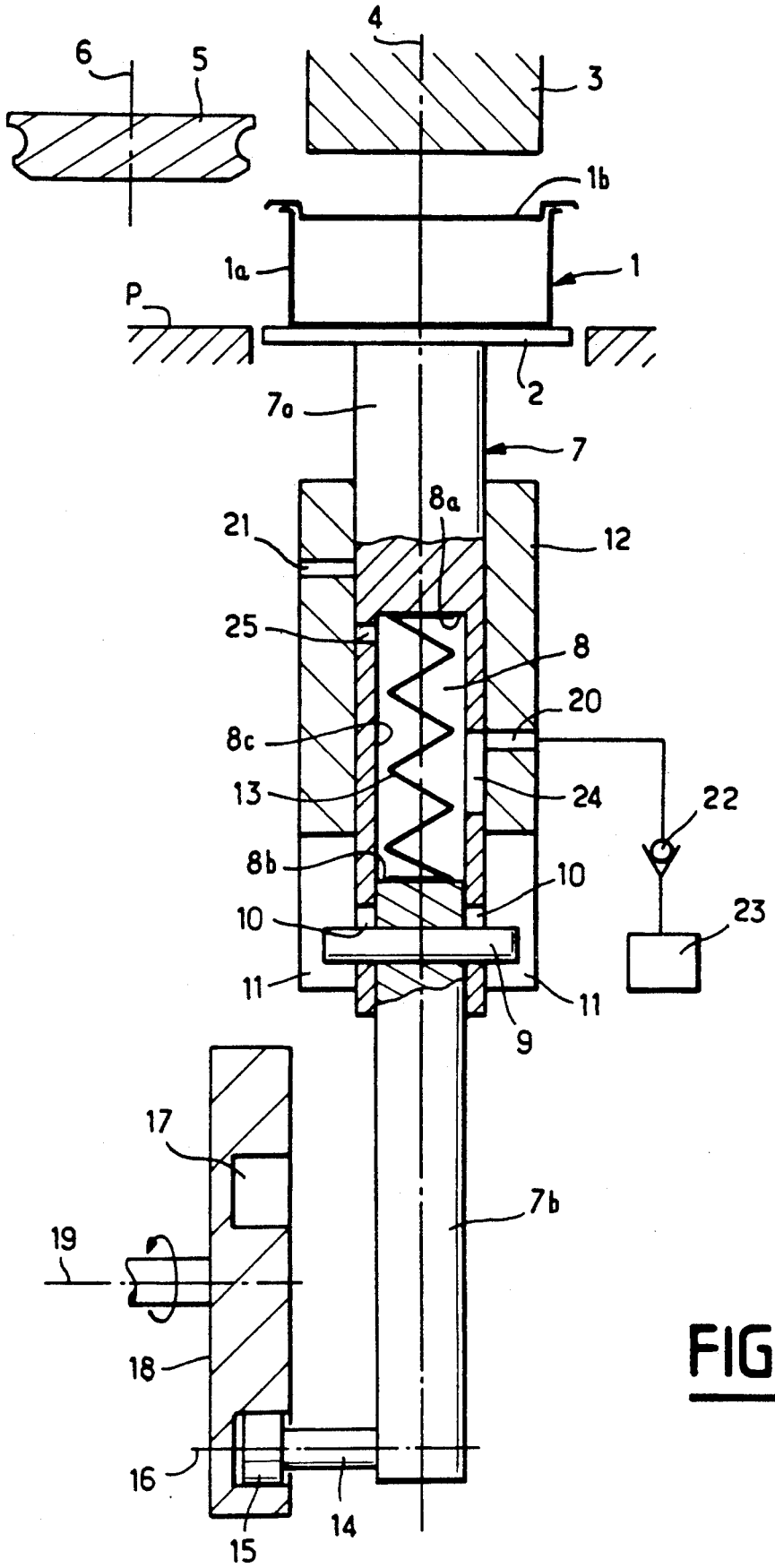
FIGS. 1 and 2 are diagrammatic axial sections through a device of the invention, respectively at the moment when a food can to be closed reaches the crimping head, and during the crimping operation proper.

FIG. 1 shows a food can comprising a can body 1*a* and a lid 1*b* overlying the body. These two elements have already been temporarily connected together by two clinch points where the edge of the lid 1*b* has been locally crimped to the top edge of the body 1*a* of the can. The food can 1 in this situation has previously been conveyed by sliding over a support plane P under drive from a convey or "star" (not shown), so as to come to rest on a plate 2 referred to as a "compression stand", located immediately beneath a fixed mandrel 3 in a centered position, with the compression stand 2 and the mandrel 3 both being centered on the axis 4 of a crimping head. The head includes rotary crimping wheels, only one of which is shown under the reference 5.

Figure 2:
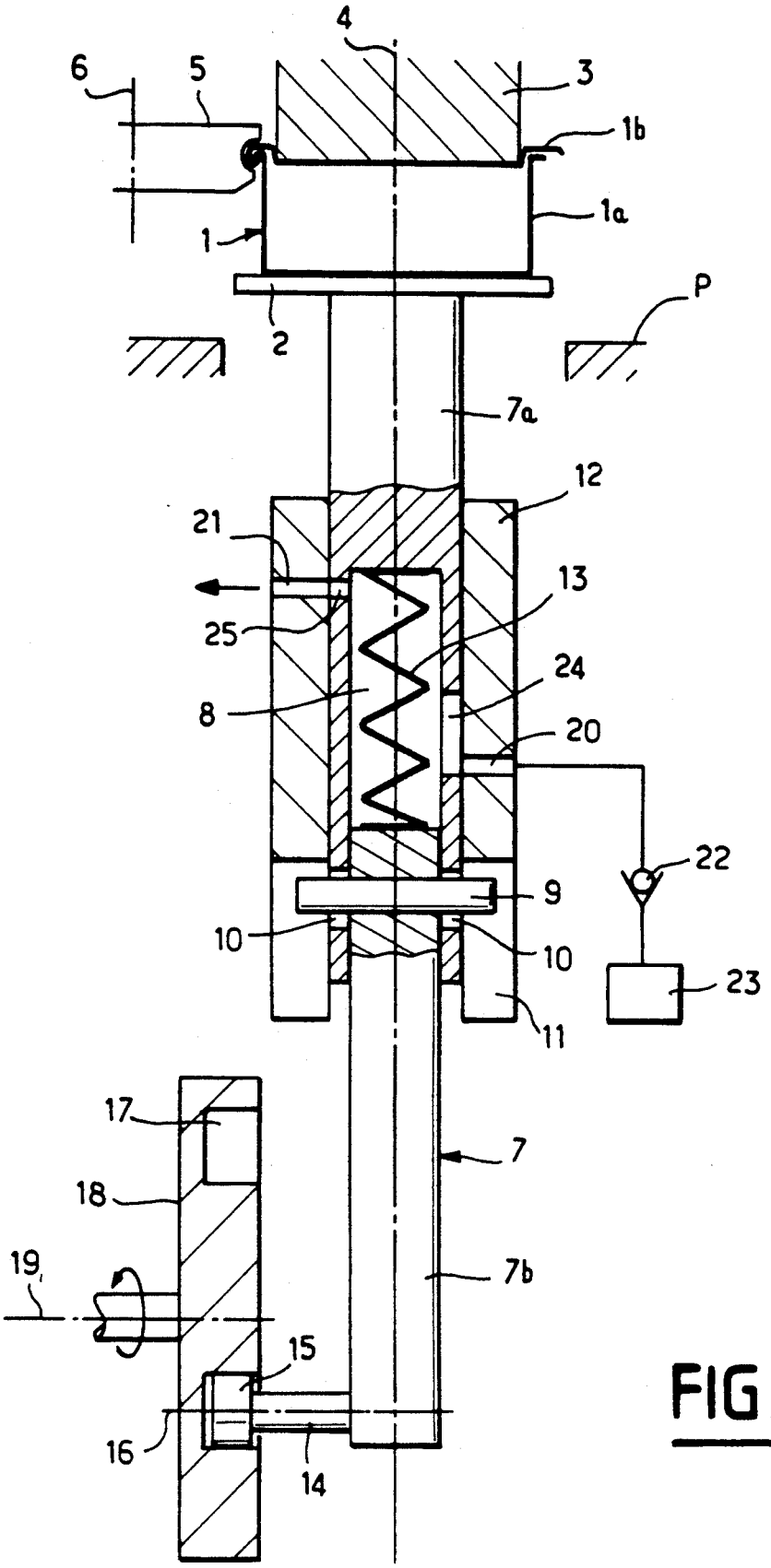

To crimp the lid 1*b* on the body 1*a* of the can, the body is raised by the compression stand 2 towards the mandrel 3 (FIG. 2) so that the lid 1*b* is pressed by the mandrel 3 onto the body 1*a* of the can with a force that is well-determined, thereby ensuring that the lid is accurately held in place. Thereafter, the axis of rotation 6 of the crimping wheel 5 is moved towards the axis 4 of the crimping head and the wheel is caused to rotate around the can 1 so as to run around the periphery thereof while performing crimping, and while being guided (by means not shown) accurately around the periphery of the can. During this operation, the crimping wheel forces the edge of the lid to wind around the edge of the box and to secure itself thereto. The crimping operation preferably takes place in two stages, under action from a first-pass crimping wheel which rolls the edges together, followed by a second-pass crimping wheel which flattens out together the rolled-up edges of the lid and of the body of the can.

The compression stand 2 is mounted at the top of a telescopic rod 7 which is aligned on the axis 4 of the crimping head. This rod is constituted by a top first element 7*a* and by a bottom second element 7*b* capable of sliding relative to each other along the direction of the axis 4. The bottom of the element 7*a* is hollowed out so as to form a cylindrical inside chamber 8 delimited by a first end wall 8*a* and by a side wall 8*c* belonging to said element, and also by a second end wall 8*b* formed by the end of the element 7*b* that slides in the chamber 8 like a piston. The amplitude of said sliding is limited by a pin 9 extending transversely through the element 7*b* to which it is fastened, and through the wall of the chamber 8 (or more exactly through an extension thereof) via a pair of slots 10 providing clearance to allow the pin 9 to move along the direction of the axis 4. In addition, the ends of the pin 9 are guided in grooves 11 extending in the direction of the axis 4 and formed radially through a stationary jacket 12 surrounding the upper element 7*a* which is free to slide longitudinally therein. Co-operation between the pin 9 and the grooves 11 prevents either of the elements 7*a* and 7*b* of the rod 7 from rotating about the axis 4, and thus prevents rotation of the compression stand 2 which is connected to the element 7*a*.

A compression spring 13 is disposed between the opposite end walls 8*a* and 8*b* that axially delimit the chamber 8, with the spring being held in the chamber under a degree of prestress that can be adjusted by means that are not shown. The spring tends to move the two elements 7*a* and 7*b* apart from each other.

The telescopic rod 7 is driven with reciprocating motion along the direction of the axis 4 in order to raise the compression stand 2 towards the mandrel 3 and to move it away therefrom in a downwards direction at appropriate instants during successive cycles of crimping operations. To this end, a part 14 carrying a roller 15 that rotates about an axis 16 perpendicular to the axis 4 is disposed projecting from the bottom portion of the element 7*a*. This roller is engaged in a closed-loop guide track 17 of appropriate outline formed in a plate 18 that rotates about its own axis 19 (which is parallel to the axis 16 of the roller 15), under drive from a motor (not shown). In practice, it is appropriate to have two such rollers 15 constituted by two adjacent parallel-axis rollers, one running against the outside flank of the track 17 and the other against its inside flank.

The fixed jacket 12 is pierced by two radial ducts 20 and 21. The duct referenced 20 is connected via a non-return valve 22 to a source 23 of liquid under pressure (in the present example this is a source of oil for oil splash lubricating the mechanism 14–18 driving the element 7*b*). The other duct, referenced 21, opens out to the atmosphere. In parallel, the side wall 8*c* of the chamber 8 is pierced by two orifices 24 and 25. The orifice 24 is elongate in shape in the direction of the axis 4 so that during translation movements of the element 7*a*, the duct 20 of the jacket 12 opens out continuously into the orifice 24, thereby enabling the chamber 8 to be fed permanently with liquid from the source 23. The orifice 25 is small in section, similar to that of the duct 21, and it is positioned so as to coincide therewith only when the element 7*a* is about to reach the end of its stroke towards the mandrel 3.

The above-described apparatus operates as follows.

Initially, when a transfer star (not shown) brings the can 1 onto the compression stand 2, the stand is flush with the plane surface P because the elements 7*a* and 7*b* of the rod are in their low position under the control of the roller 15 as guided in the track 17 of the rotary plate 18. Under bias from the spring 13, the rod 7 is in its extended configuration, as defined by the pin 9 coming into abutment against the bottom ends of the slots 10. The orifice 25 does not coincide with the duct 21, so the duct is closed by the wall of the jacket 12 such that the oil filling the chamber 8 cannot escape therefrom, since the orifice 25 is shut off, while the orifice 24 is under the control of the non-return valve 22. This captive mass of oil causes hydraulic coupling to be established between the elements 7*a* and 7*b* constituting the rod 7, thus holding them securely together.

Because of the rotation of the plate 18, the roller 15 begins to move upwards, causing the element 7*b* and consequently the element 7*a* to move towards the mandrel 3. These two elements then move together as a single piece with the rod 7 that they constitute together responding accurately to the motion imparted by the roller 15, regardless of the amount of acceleration that may be communicated thereto. During this stage, the spring 13 is completely inoperative.

As a result, the can 1 can be moved towards the mandrel 3 very quickly. However, when the lid 1*b* is about to contact the mandrel (FIG. 2), the orifice 25 will have reached the duct 21, so the oil contained in the chamber 8 can escape therethrough to the outside. The pressure in the chamber consequently drops to zero, and the two elements 7*a* and 7*b* are thus decoupled from each other. The spring 13 then produces its effect which is to urge the element 7*a* towards the mandrel with a determined amount of force that corresponds to the prestress applied to the spring between the elements 7*a* and 7*b*. The resulting compression force of the lid 1*b* against the body 1*a* of the can can thus be relatively small since it is applied only at the end of the stroke of the element 7*b* which is actuated during the major portion of its stroke in a manner that is independent from the spring 13 since it is hydraulically locked to the element 7*b* under drive from the roller 15, with the locking being provided via the chamber 8 which is filled with oil and which is closed. This way of driving the compression stand 2 in translation makes it possible simultaneously to obtain a high operating throughput while avoiding the unwanted effects of the inertia of the element 7*a* relative to the element 7*b*, and to obtain a measured amount of compression force applying the lid 1*b* onto the body 1*a* of the can. In particular, this force can be adjusted to a very low value when the body of the can is fragile, e.g. because it is made of very thin aluminum sheet.

The roller 15 in its guide track 17 then acts via the rod 7 and the compression stand 2 to keep the lid 1*b* pressed on the body 1*a* of the can throughout the time taken by the crimping wheels that have been brought into contact with the can 1 to rotate thereabout and fasten the lid to the can around its entire periphery by crimping. Under such circumstances, it is important for the elements 7*a* and 7*b* to be connected via the spring 13 only, which implies that the slots 10 in which the pin 9 is engaged must be long enough to ensure that once the pin 9 has left the bottom ends of the slots due to the spring 13 compressing, it does not come into abutment against the top ends of the slots, since that would give rise to rigid connection being reestablished in unduly manner between the two elements 7*a* and 7*b*.

Once crimping has been completed, the wheel 15 begins to cause the element 7*b* to move downwards. The element 7*a* also moves downwards, being driven by the pin 9 coming into contact with the bottom ends of the slots 10. Almost immediately thereafter, the orifice 25 of the chamber 8 leaves the discharge duct 21 such that the oil contained in the chamber is again held captive therein and as a result hydraulic locking is re-established between the elements 7*a* and 7*b* of the rod 7 which finally returns to its low position as shown in FIG. 1 under drive from the roller 15.

By way of example, the device described above for closing food cans can be implemented so as to raise throughput from about 80 cans per min. to 200 or more cans per min., with throughput now being limited by the crimping head rather than by the compression mechanism.

I claim:

1. A device enabling the lid of a food can to be crimped in place, the device comprising a crimping head and a compression stand for supporting the body of a food can on which a lid has been placed, and for pressing said lid onto the body of the can by urging the can against a fixed mandrel with a determined force throughout the crimping operation, a telescopic rod comprising first and second elements capable of sliding relative to each other and extending along an axis perpendicular to a support surface provided by the compression stand, the compression stand being fixed to an end of said first element, a spring urging said first and second elements apart from each other, said second element being coupled to drive means suitable for imparting longitudinal reciprocating translation motion to said second element between two defined extreme positions, namely a rest position at a distance from the above-specified mandrel and a working position causing the mandrel to hold the lid down on the body of the can against thrust imparted via said spring, the first element of the rod, and the compression stand, so that said rod has a stroke towards the mandrel, wherein the telescopic rod is provided with means for mutual temporary locking together of said first and second elements of said rod, which means keep said first and second elements stationary relative to each other in a relative position where the spring is in a state of determined prestress, with this taking place during a major portion of said stroke of said rod towards the mandrel, and then, shortly before the end of said stroke, releasing said second element relative to said first element, causing said first element to press the lid against the body of the can solely under the effect of the force developed by the spring under said prestress.

2. A device according to claim 1, wherein said locking means between said first and second elements of the telescopic rod comprise a chamber having an inside volume delimited by walls belonging respectively to said first and second elements, the inside volume of the chamber being directly determined by a mutual position of said first and second elements as they slide relative to each other, the locking means also comprising abutment means which set a position of maximum extension of the rod, and wherein the chamber is permanently connected to a source of liquid under pressure, and also to a path for discharging said liquid from the chamber, but only when the rod completes said major portion of said stroke.

3. A device according to claim 2, wherein the chamber is connected to the source of liquid under pressure via a duct that includes a non-return valve.

4. A device according to claim 2, wherein the inside volume of the chamber increases or decreases as the elements of the rod slide relative to each other, thereby respectively extending the rod or retracting it.

5. A device according to claim 4, wherein the chamber is delimited by an end wall and by a tubular side wall belonging to one of the first and second elements of the rod, and by a piston constituted by an end of the other element, said piston being slidably received in the chamber, and wherein said wall is pierced by a first orifice in permanent communication with the source of fluid under pressure, and by a second orifice that communicates with a discharge duct only at the end of the stroke of the element to which the said side wall belongs.

6. A device according to claim 5, wherein the element to which the side wall of the chamber belongs is the first element, the piston being constituted by the end of the second element.

7. A device according to claim 2, wherein said second element has a residual stroke during movement toward said working position after being unlocked from the first element, and the abutment means comprise a pin passing through both the first and second elements of the rod, passing through at least one of said elements via a slot or a pair of slots enabling the two elements to slide relative to each other with an amplitude greater than the residual stroke executed by the second element after being unlocked from the first element.

8. A device according to claim 7, wherein the ends of the pin are received in a pair of guide grooves formed in a stationary part and extending along the same direction as the axis of the telescopic rod.

* * * * *